US006626070B2

(12) United States Patent
Peperkorn et al.

(10) Patent No.: US 6,626,070 B2
(45) Date of Patent: Sep. 30, 2003

(54) COMPOUND TOGGLE LINK RETENTION MECHANISM

(75) Inventors: William D. Peperkorn, DeWitt, NE (US); Thomas O. Miller, DeWitt, NE (US); Brian L. Rahe, DeWitt, NE (US); Robert L. Rhynalds, Wilber, NE (US)

(73) Assignee: Irwin Industrial Tool Company, Freeport, IL (US)

( * ) Notice: Subject to any disclaimer, the term of this patent is extended or adjusted under 35 U.S.C. 154(b) by 0 days.

(21) Appl. No.: 09/849,948

(22) Filed: May 4, 2001

(65) Prior Publication Data

US 2002/0162427 A1 Nov. 7, 2002

(51) Int. Cl.[7] ..... B25B 7/12
(52) U.S. Cl. ..... 81/370; 81/369
(58) Field of Search ..... 81/367–384

(56) References Cited

U.S. PATENT DOCUMENTS

| | | | | |
|---|---|---|---|---|
| 936,980 | A | | 10/1909 | Bing |
| 2,156,529 | A | | 5/1939 | Day |
| 2,250,400 | A | | 7/1941 | Stephens |
| 2,312,947 | A | | 3/1943 | Westman |
| 2,464,472 | A | | 3/1949 | Ward et al. |
| 2,487,281 | A | | 11/1949 | Steckelberg |
| 2,496,309 | A | | 2/1950 | Pugh |
| 2,499,201 | A | | 2/1950 | Thayer |
| 2,514,130 | A | | 7/1950 | Jones |
| 2,523,385 | A | | 9/1950 | Mead |
| 2,531,285 | A | | 11/1950 | Manspeaker |
| 2,543,922 | A | | 3/1951 | Mead |
| 2,576,285 | A | | 11/1951 | De Groote et al. |
| 2,584,952 | A | | 2/1952 | Westerman et al. |
| 2,595,579 | A | | 5/1952 | Hawkins |
| 2,600,594 | A | | 6/1952 | Williamson |
| 2,617,312 | A | | 11/1952 | Prentice |
| 2,618,188 | A | | 11/1952 | Emmett |
| 2,643,567 | A | | 6/1953 | Johnson |
| 2,661,648 | A | | 12/1953 | Jones |
| 2,669,145 | A | | 2/1954 | Mead |
| 2,751,801 | A | | 6/1956 | Hostetter |
| 2,777,347 | A | | 1/1957 | Sendoykas |
| 2,800,823 | A | | 7/1957 | Tugend |
| 2,815,728 | A | | 12/1957 | Fenimore |
| 2,838,973 | A | * | 6/1958 | Petersen ..... 81/369 |
| 2,988,941 | A | | 6/1961 | Ortman |
| 2,997,903 | A | | 8/1961 | Rommel et al. |
| 3,104,571 | A | | 9/1963 | Trybus |
| 3,190,155 | A | | 6/1965 | Ortman |
| 3,195,382 | A | | 7/1965 | Rommel et al. |
| 3,208,319 | A | | 9/1965 | Westby et al. |
| 3,252,360 | A | | 5/1966 | Ortman |

(List continued on next page.)

FOREIGN PATENT DOCUMENTS

| | | |
|---|---|---|
| CA | 463670 | 3/1950 |
| CA | 499110 | 1/1954 |
| CA | 642102 | 6/1962 |
| DE | 1954491 | 8/1978 |
| EP | 1023972 A2 | 8/2000 |
| FR | 976867 | 11/1950 |
| FR | 1255515 | 1/1960 |
| WO | WO 97/34738 | 9/1997 |

*Primary Examiner*—James G. Smith
(74) *Attorney, Agent, or Firm*—Brinks Hofer Gilson & Lione

(57) ABSTRACT

A quick release and toggle locking mechanism for a conventional pliers-type, toggle-locking hand tool comprises a compound toggle link. The mechanism includes a compound link pivotally connected to a movable handle and a toggle link. Retention means is provided for restricting pivotal movement of the compound link relative to the movable handle.

8 Claims, 8 Drawing Sheets

U.S. PATENT DOCUMENTS

| | | | | | |
|---|---|---|---|---|---|
| 3,262,343 | A | | 7/1966 | Weller | |
| RE26,280 | E | | 10/1967 | Hostetter | |
| 3,354,759 | A | | 11/1967 | Cook | |
| 3,496,808 | A | | 2/1970 | Schmidt | |
| 3,545,316 | A | | 12/1970 | Patrick | |
| 3,590,669 | A | | 7/1971 | Marasco | |
| 3,600,986 | A | | 8/1971 | Baldwin, Jr. | |
| 3,657,948 | A | | 4/1972 | Myers | |
| 3,657,949 | A | | 4/1972 | Myers | |
| 3,793,914 | A | | 2/1974 | Helms | |
| RE32,614 | E | | 3/1988 | Wilson | |
| 4,820,901 | A | | 4/1989 | Peviani | |
| 4,889,021 | A | | 12/1989 | Morrison | |
| 4,893,530 | A | | 1/1990 | Warheit | |
| 5,056,385 | A | * | 10/1991 | Petersen | 81/367 |
| 5,060,543 | A | | 10/1991 | Warheit | |
| 5,197,359 | A | | 3/1993 | Mills | |
| 5,251,353 | A | | 10/1993 | Lin | |
| 5,385,072 | A | | 1/1995 | Neff | |
| 5,435,214 | A | | 7/1995 | Sisson | |
| 5,460,065 | A | * | 10/1995 | Balmer | 81/368 |
| 5,609,080 | A | * | 3/1997 | Flavigny | 81/368 |
| 5,644,960 | A | | 7/1997 | O'Brien | |
| 6,006,385 | A | | 12/1999 | Kershaw et al. | |
| 6,012,361 | A | | 1/2000 | Wooster, Jr. et al. | |
| 6,014,917 | A | | 1/2000 | Bally et al. | |
| D428,317 | S | | 7/2000 | Lin | |
| 6,082,231 | A | * | 7/2000 | Tsai | 81/367 |
| 6,095,019 | A | | 8/2000 | Warheit et al. | |
| 6,155,142 | A | | 12/2000 | Bally et al. | |
| 6,178,855 | B1 | | 1/2001 | Bally et al. | |
| D437,756 | S | | 2/2001 | Lin | |
| 6,199,458 | B1 | | 3/2001 | Wrigley et al. | |
| 6,212,977 | B1 | | 4/2001 | Liou | |

* cited by examiner

FIG. 8
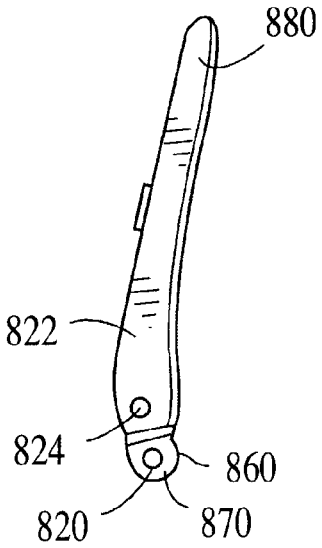
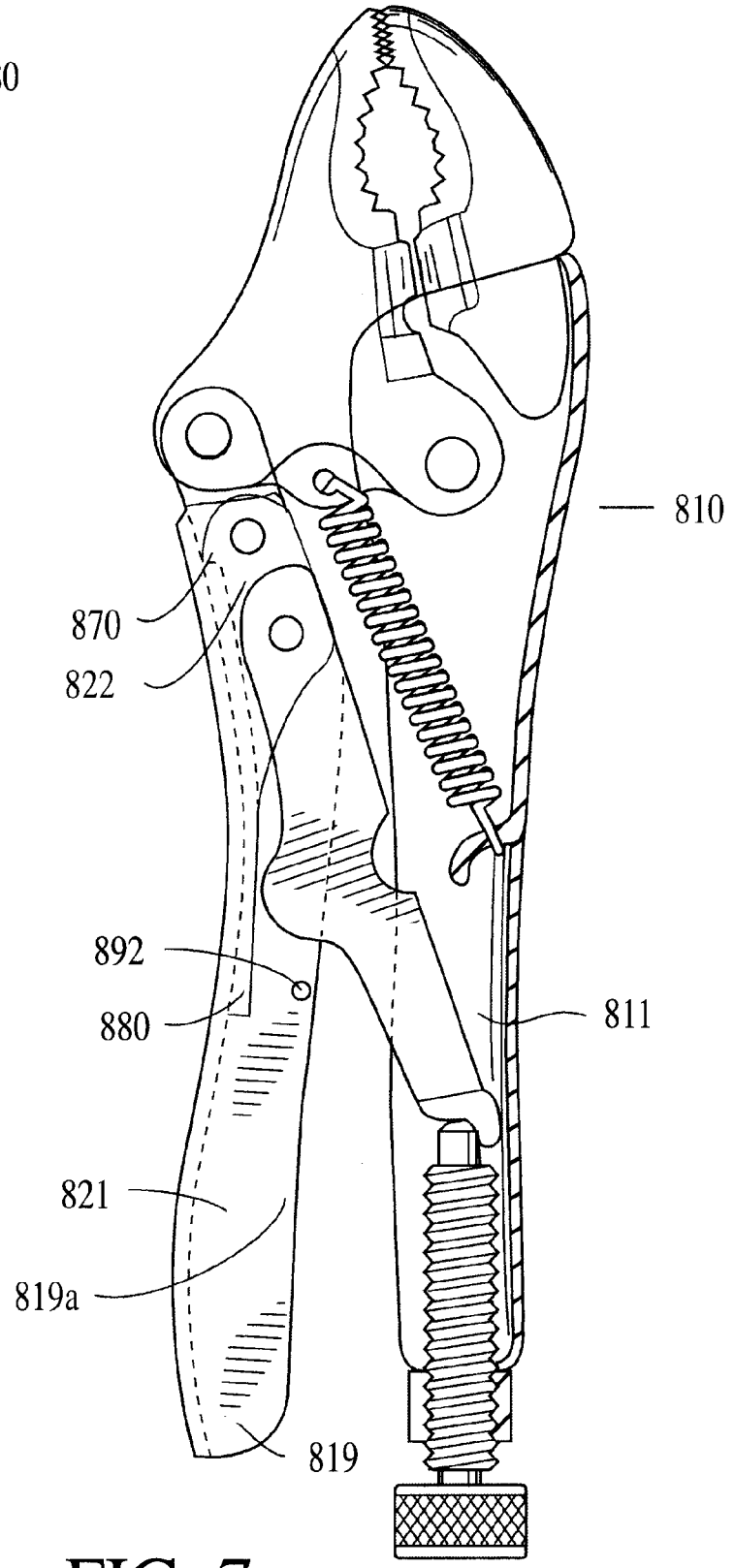
FIG. 7

COMPOUND TOGGLE LINK RETENTION MECHANISM

FIELD OF THE INVENTION

The present invention relates to release mechanisms for toggle-locking hand pliers. In particular, it relates to a structure for retaining compound toggle linkages for locking and releasing hand tools used for clinching onto various workpieces and remaining locked thereto without being held continuously by the worker.

BACKGROUND OF THE INVENTION

Toggle-locking pliers typically utilize a movable jaw and a fixed jaw to firmly grasp and lock onto a workpiece. Typically, the movable jaw may be adjusted to grasp the workpiece as the handles are compressed together. As the handles are more tightly compressed, the toggle mechanism will lock the hand tool onto the workpiece. After the user releases the handles, the tool will remain firmly locked in place. Adjustments to the clamping force may generally be made by rotating an adjusting screw in the base of the fixed handle. By rotating the screw, the configuration of the toggle mechanism of the pliers is modified, thereby providing more or less relative force between the handle position and the position of the closed or open jaws.

Conventional toggle locking pliers include three pivot points in what is known as the "power line" from the pivot point of the movable handle on the movable jaw down through an inner pivot near the end of the spanning toggle link. The other end of the toggle link rests pivotably at the tip of the adjusting screw in the channel of the fixed handle. Locking the handle causes the center pivot point to cross the "power line" between the two outer pivots. Unlocking the conventional locking hand tool involves forcing the single center pivot back across the "power line". Usually, this is carried out by means of a release lever pivotably mounted in the channel of the movable handle. The release lever is pushed against a projection on the toggle link, thus causing the toggle link to pivot outward and drive the two handles apart to release the clamping action of the jaws.

An alternative to the release lever arrangement is shown in U.S. Pat. No. 5,056,385. This patent discloses a five-pivot toggle mechanism located between the fixed and movable handles of a toggle-locking hand tool, with a compound toggle linkage mechanism fitting inside the channel of the movable handle. The spanning toggle link is of a conventional design with a transverse projection located near the midpoint. The projection, upon clamping the handles together, fits into the channel of the movable handle acting as a stop to limit closure. An added or second link is pivotably mounted completely within the channel of the movable handle. In the closed locking position, the second or compound link extends from a contact with the projection of the spanning link past the end of the spanning link. The spanning link is pivoted to the compound link. The spanning link further extends to an additional pivot on the movable handle between the pivot point for the spanning link and the conventional pivot point for the movable handle with the movable jaw.

This compound linkage greatly increases the mechanical advantage of the movable handle. Thus, a small urge by the user outward at the inside end of the movable handle springs the two inner pivot points of what is now a four point "power line" of the locking hand tool back across the "power line", thus unlocking the tool with minimal wear.

The compound linkage arrangement shown in U.S. Pat. No. 5,056,385 tends to allow the compound link to extend beyond the width of the movable handle in some unlocked configurations. Furthermore, the configuration of the compound link may have some shortcomings with respect to user feedback and the ability of the user to sense when toggling has taken place.

BRIEF DESCRIPTION OF SEVERAL VIEWS OF THE DRAWINGS

FIG. 7 is a cut-away view of a hand tool implementing a second embodiment of the present invention;

FIG. 8 is a view of a portion of the compound toggle link shown in FIG. 7 implementing an aspect of the present invention.

SUMMARY OF THE INVENTION

The present invention improves on the mechanism shown in U.S. Pat. No. 5,056,385, which is assigned to the same assignee of the present invention and is incorporated herein by reference. In embodiments disclosed herein, an improved compound toggle link is provided having an improved shape to more effectively provide toggling feedback to the user. Furthermore, a retention mechanism is provided to prevent extension of the toggle link mechanism past or substantially past the width of the handle. In various embodiments, these improvements provide for ease of manufacture, improved product appearance, and improved workability.

DETAILED DESCRIPTION OF THE PREFERRED EMBODIMENT

In a conventional locking hand tool of the prior art, there are four pivot points around which the parts of the tool rotate in opening and closing the tool. In the open position, these four pivots outline a trapezoid. In the closed position, these pivots approximate a right triangle. The hypotenuse of this triangle containing three of the pivots is called the "power line". The right angle of the right triangle is the pivot point for the movable jaw. The hypotenuse contains the pivot for the movable handle at the movable jaw and the pivot for the toggle link on the movable handle, also on the hypotenuse is the other end of the toggle link in a pivoting, sliding contact at the end or tip of the adjusting screw in the channel of the fixed handle of the tool. Locking a conventional tool moves the toggle link pivot with the moving handle inwardly slightly across the power line forming the right triangle. Releasing the conventional tool snaps the toggle link pivot with the moving handle outwardly away from the fixed handle, beyond the former power line.

In the locking pliers arrangement shown and disclosed in U.S. Pat. No. 5,056,385 and incorporated herein by reference, there are five pivot points forming a pentagon when the tool is open and a triangle when the tool is closed. An additional compound toggle link has been inserted into the mechanism. Clamping the tool forces the two internal pivots of the pentagon toward the fixed handle across the power line to form the triangle. Releasing the tool clamping action by flicking the end of the movable handle away from the fixed handle snaps the two internal pivots back across the power line, thereby changing the triangle back to its pentagon configuration. The increased mechanical advantage for releasing the tool, is the ratio of the length of the movable handle to the distance between the handle pivot point and the compound link pivot point. The ratio of these two lengths may be from about 4 to about 16, preferably from about 6 to about 10.

Figure 1:
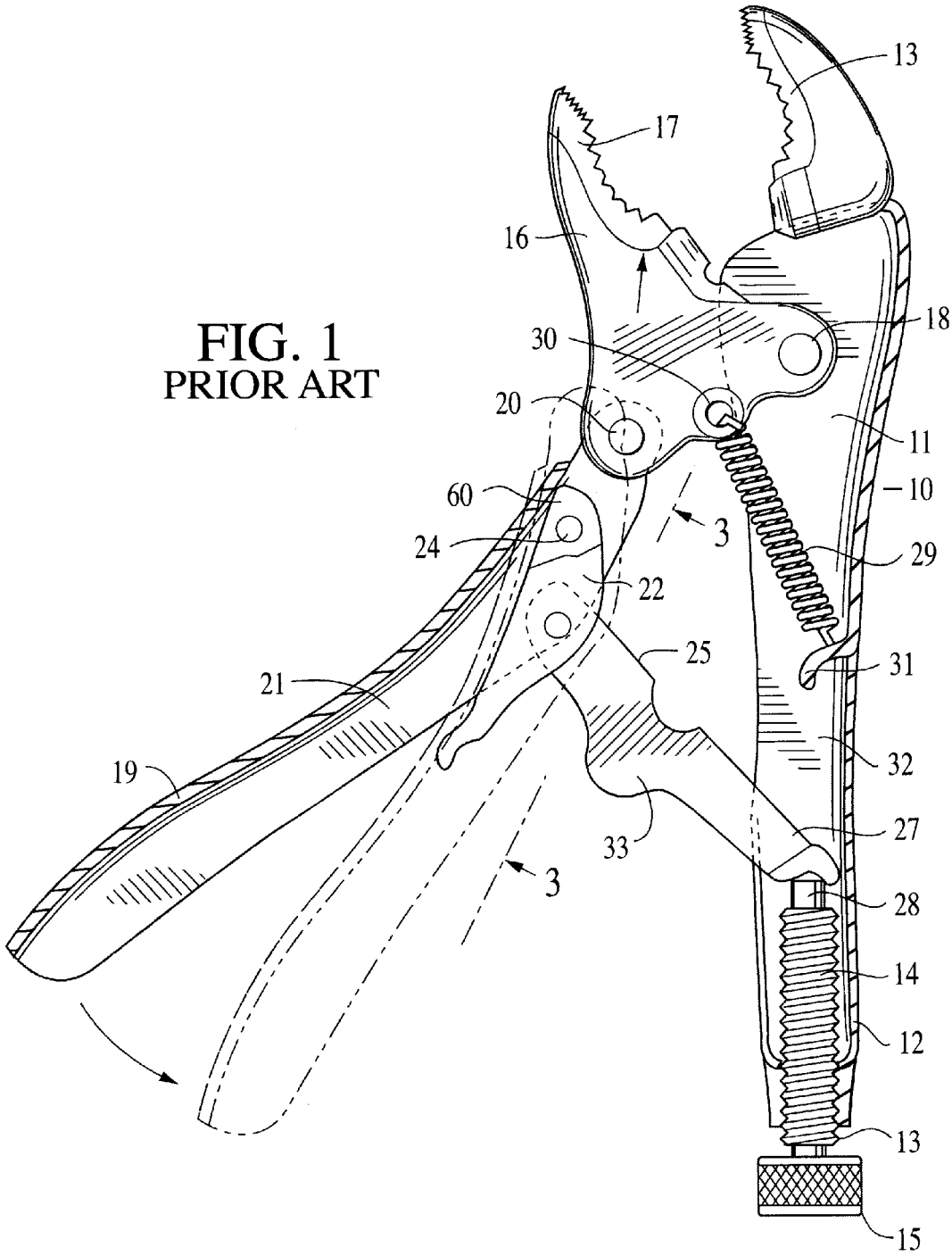
FIG. 1 PRIOR ART
FIG. 1 is a side view of a prior art hand tool in the open, unclamped position.
Figure 2:
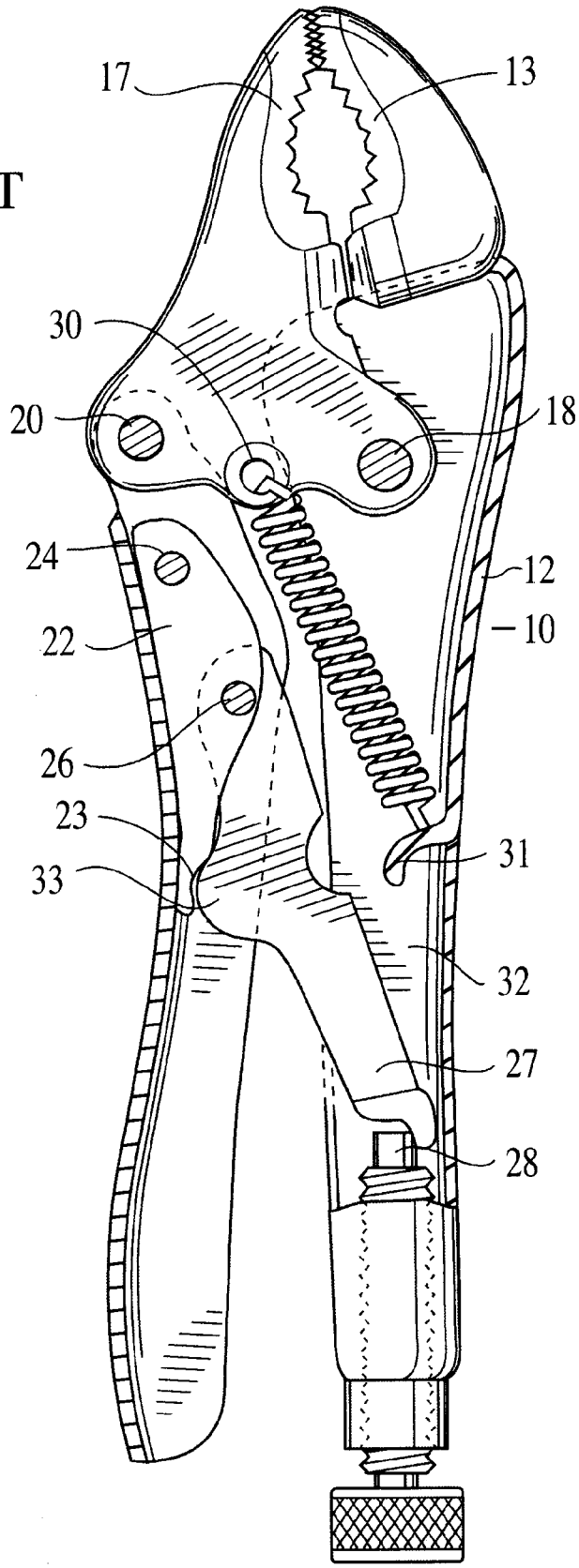
FIG. 2 PRIOR ART
FIG. 2 is a side view of a prior art hand tool in its closed, locked position.
Figure 3:
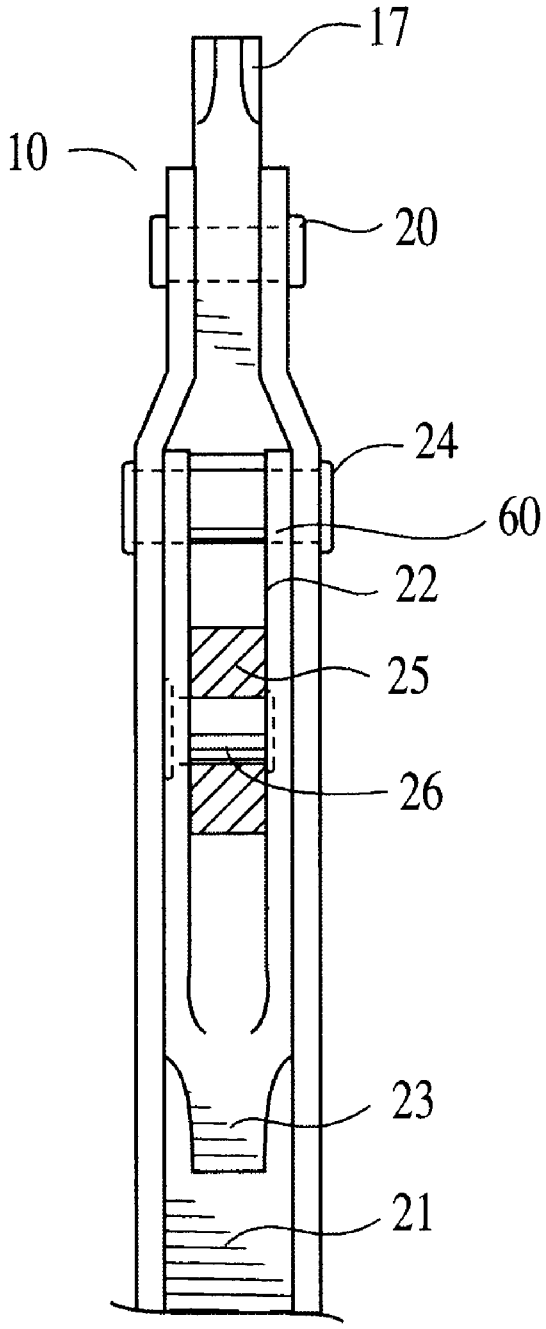
FIG. 3 PRIOR ART
FIG. 3 is a fragmentary view of FIG. 1 taken along the line 3—3.

The tool 10 of FIGS. 1–3 includes a fixed arm and body 11 having a fixed handle 12 at one end and a fixed jaw 13 at the other end. The jaw 13 is fixedly connected to the handle 12. The handle is formed as a generally U-shaped, elongated channel. The end of the fixed handle 12, remote from the jaw 13, is completed with a threaded circular aperture 13 through which a threaded screw 14 is threadably engaged. The screw 14 preferably terminates in a knurled adjusting knob 15.

A movable arm 16 includes a movable handle 19, which is formed as a channel, and a movable jaw 17 which is pivotably connected at one end of the movable handle 19 by the pivot pin 20. A pivot pin 18 connects the movable jaw 17 to the fixed handle 12. Within the channel 21 of the movable handle 19, is located the compound link 22 which is also in the form of a U-shaped channel. The compound link 22 is pivotably connected to the movable handle 19 by a pivot pin 24 located on a flange end 60 of the link 22.

A toggle link 25 spans the distance between the fixed handle 12 and the compound link 22 where the toggle link is pivotably connected by the pivot pin 26. The other end 27 of the toggle link 25 is slidably and pivotably engaged with the end 28 of the adjusting screw 14. A projection 33 extends transversely to the length direction of the toggle link 25 and acts as a stop when the jaws are in the closed position by making contact with the end 23 of the compound link 22.

As is apparent from the drawing, turning the adjusting screw 14 changes the distance between the end 27 of the toggle link 25 and the pivot point 18 of the movable jaw 16, whereby the jaws may be adjusted to grip objects of different dimensions without exerting excessive force.

A biasing spring 29 extends between an opening 30 on the movable jaw 16 to a tab 31 protruding within the channel 32 of the fixed handle 12. The spring 29 applies a bias which tends to separate the jaws 13, 17, one from the other.

When the jaw 13,17 are apart, the five pivots, namely, pivot 18, 20, 24, 26, and the pivoting contact between toggle link 25 at its end 27 with the end of the adjusting screw 14, are arranged as a polygon without distinguishing characteristics. On the other hand, when the jaws are locked together, the pivot points 20, 24, 26 and the pivoting contact 27, 28 are substantially in a straight line, thus forming a right triangle with the other pivot 18. The pins 24, 26 are in an over-center position and can move no closer to the fixed handle 12 because the protrusion 33 presses against the compound link 22 at the end 23.

As in the prior art over-center pliers, the jaws 13, 17 cannot be pried apart from the locked position by use of force which pulls or pushes on the jaws 13, 17, as separation of the jaws is prevented by the over-center condition of the pins 24, 26. However, the jaws 13, 17 in accordance with the invention, are readily separated by applying a force to the movable handle 19 in a direction which moves the movable handle 19 away from the fixed handle 12.

Of course, the mechanism described above, with reference to FIGS. 1–3 can be applied to tools such as C-clamps and long-nose pliers to provide quick and easy opening of the jaws. However, it should be understood that the compound toggle link in accordance with the Disclosure is not limited to the over-center type tools illustrated in the application here.

It should be further understood that whereas the specification above describes an "over-center" condition of the pivot pins 24, 26, which maintains the jaws in a locked position, "over-center" should also be construed to include a pin arrangement which lines the pins up on "dead center," that is, in a straight line. Basically, any configuration of pivot pins and stops, for example, the stop 33, which places the mechanism in a locked position when the jaws are closed or grasping a workpiece, can be considered an over-center mechanism when force applied directly to the jaws to separate the jaws is not effective in moving the jaws. The jaws can only be moved by forces acting on the links of the mechanism.

Figure 4:
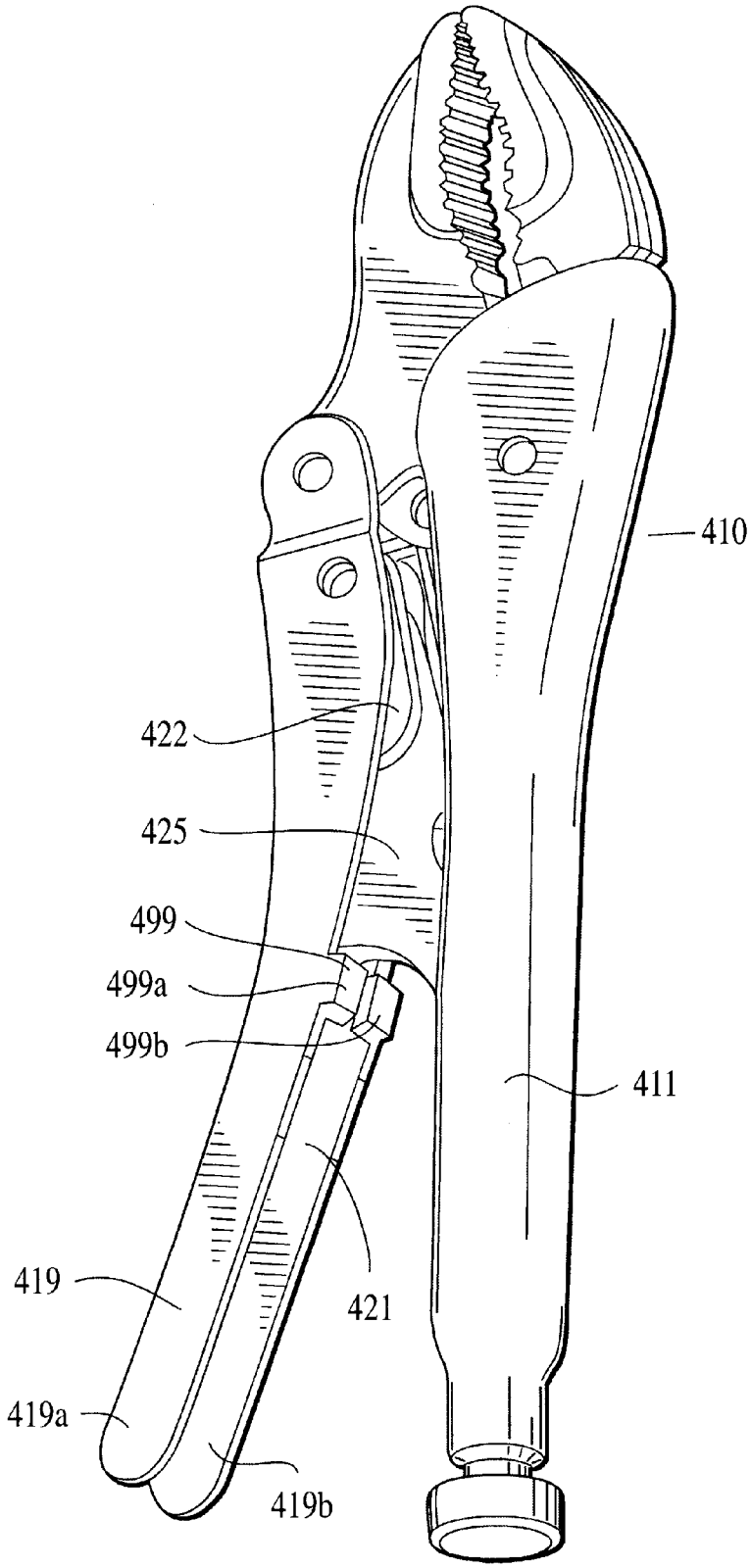
FIG. 4 is a perspective view of an embodiment of the hand tool implementing the present invention, the hand tool being in the closed position.
Figure 5:
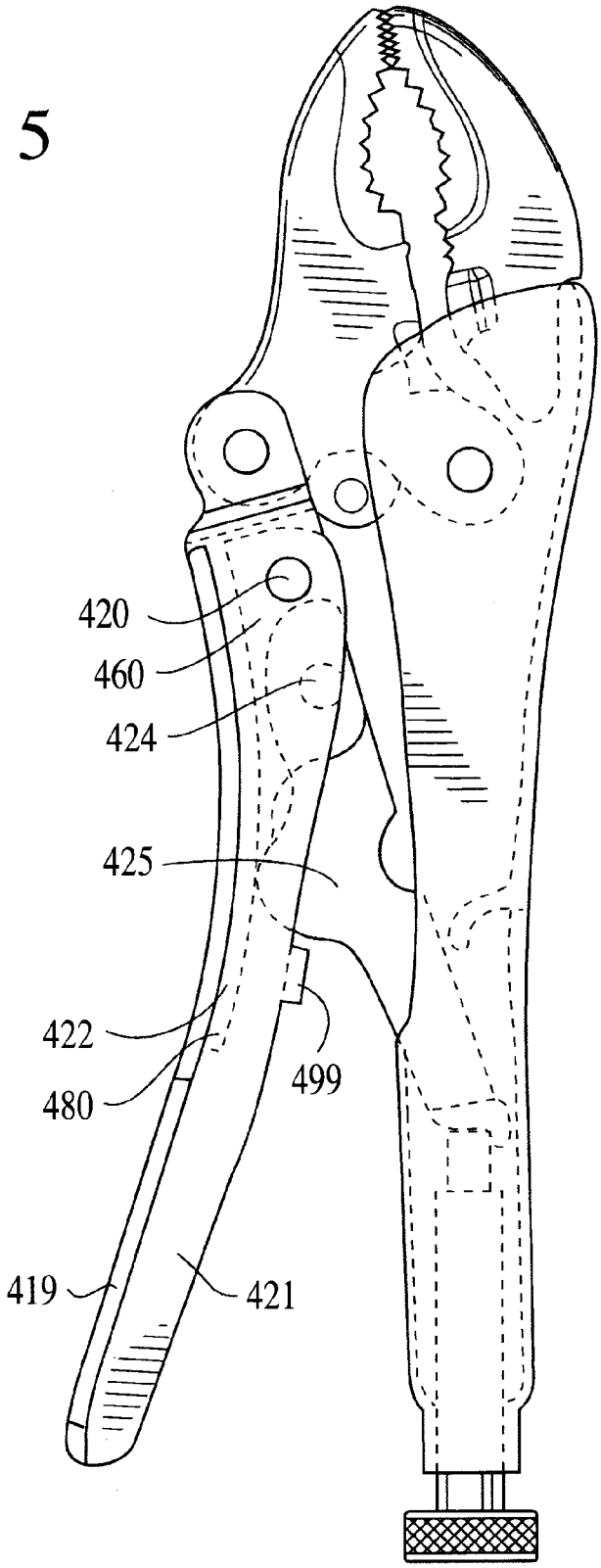
FIG. 5 is a partial cut-away view of the hand tool of FIG. 4.
Figure 6:
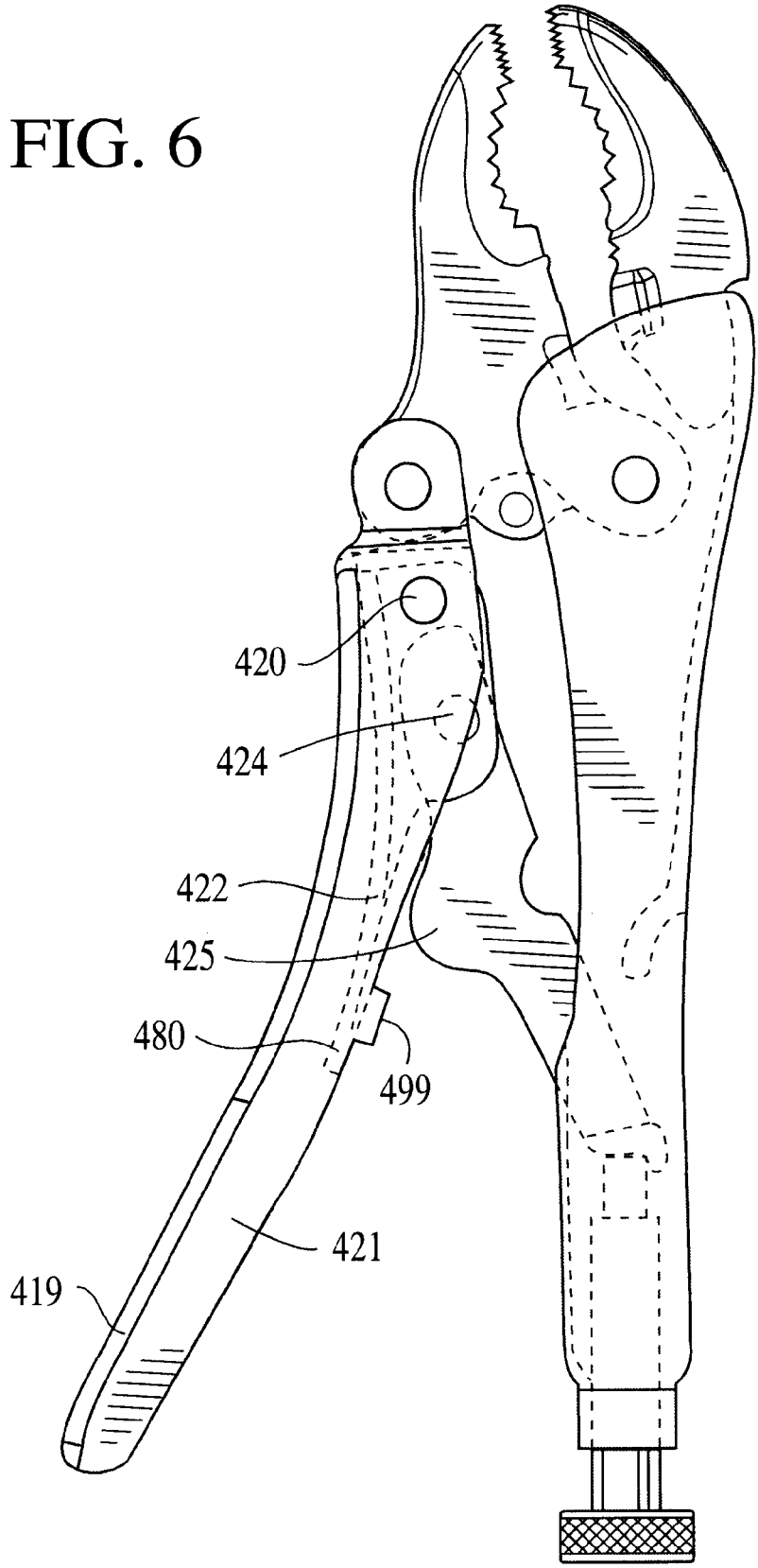
FIG. 6 is a partial cut-away view of the hand tool of FIG. 4 showing the tool in the open position.

In accordance with the present invention, an improved embodiment of a locking pliers 410 is shown in the drawings in FIGS. 4, 5 and 6. FIGS. 4 and 5 depict views of the pliers 410 in the closed position, and FIG. 6 shows the pliers in the open position. In these drawings, similar numerals are utilized to show similar parts as shown in FIGS. 1–3, with the prefix "4" added thereto.

As shown in the figures, the compound toggle link 422 includes an elongated lever end 480 extending from the flange end 460 of the link 422. Preferably, the lever end 480 is curved slightly to track a portion of the shape of the outside of the movable handle 419 including a first handle wall 419*a* and a second handle wall 419*b*. As shown in the drawings, the toggle link 425 is linked to pivot point 424 on the flange end 460 of the toggle link 422. In turn, the flange 460 of the toggle link 422 is also connected at pivot 420 to an end of the movable handle 419. This provides a portion of the linkage structure as described above in the previous Figures. In the present embodiment, the elongated lever end 480 extends further down the length of the channel 421 within the movable handle 419.

In accordance with the present invention, a compound toggle link retention means 499 is provided to restrict the lever end 480 of the compound toggle link so that the elongated end 480 does not extend out of the channel 421 when the pliers 410 is in the open position of FIG. 6. As shown in FIG. 4, in the present embodiment, the retention means 499 preferably comprises a pair of folded over flanges 499*a* and 499*b* connected to the first handle wall 419*a* and the second handle wall 419*b* of the movable handle 419 inwardly and transversely over the channel 421. As shown in FIG. 6, the elongated end 480 of the toggle link 422 abuts the retention means 499 as the pliers extend into the open position. This configuration provides a "cleaner" looking tool to the user by holding the end of the compound toggle link 422 within the channel 421 and preventing its outward pivoting. Furthermore, the flanges 499*a* and 499*b* allow the end 480 to "snap" against the flanges upon unlocking, thereby providing a tactile feedback to the user.

It is important to note that, although FIGS. 4, 5 and 6 show the retention means 499 as having bent flanges 499*a* and 499*b* upstanding slightly out of the edge of the channel 421, the flanges may be configured or bent to be recessed partially or fully into the channel 421. In such a configuration, the flanges 499*a,* 499*b* would not be visible along the handle 419 in FIGS. 5–6.

Instead of the particular bent flanges 499*a* and 499*b* shown in FIGS. 4–6, another embodiment of the retention means may be used, for example, as shown in FIG. 7. FIG. 7 illustrates an alternate embodiment of the pliers 810, again utilizing similar figure numbers as in previous figures with a prefix of "8." In this Figure, a roll pin 892 extends transversely between the outside walls 819*a* of the movable handle 819. The roll pin 892 serves the same purpose as the bent flanges 499*a* and 499*b* shown in the previous Figures, in that the pin 892 prevents the elongated end 880 of the compound toggle link 822 from pivoting out of the channel 821. The pin may be stainless steel or any other suitable material that is either riveted or otherwise fixed in place on the handle 819, and need not extend completely across the channel 821.

In this embodiment, a further improvement to the structure of the compound toggle link 822 is shown in FIG. 8. In particular, the flange end 860 of the compound toggle link 822 includes an interior rounded end 870 as shown. This rounded end 870 differs from the more angular corresponding portion in the previous embodiments. This curved portion adjacent the pivot pin 820 allows a smoother pivoting action of the compound toggle link 822. Thus, when the pliers 810 is opened into the open position, the elongated end 880 is allowed to pivot toward the fixed body 811 of the locking pliers 810. The rotation of the compound toggle link flange portion 822 occurs more smoothly because the rounded end 870 provides a smoother interface with the side wall of the interior of the movable handle 819.

Figure 9:
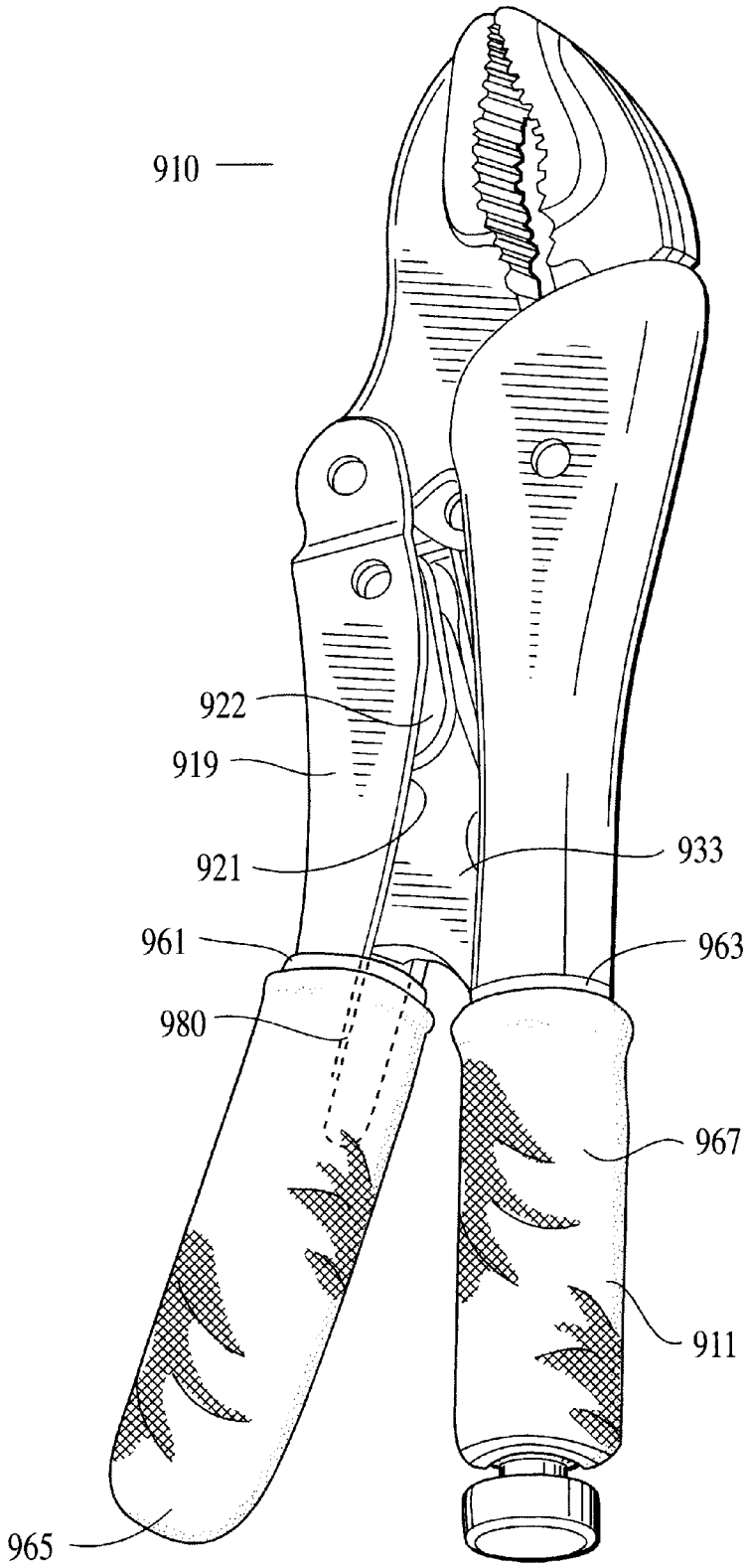
FIG. 9 is an embodiment of the hand tool shown in FIG. 4 showing a third embodiment of the present invention.

A third embodiment of the present invention is shown in FIG. 9. In the embodiment of the locking pliers 910, elastomeric grips are provided on the handles 919 and 911. The elastomeric handles provide a smoother and larger gripping surface so that the user may more comfortably use the tool 910 with less fatigue and a more secure grip. In this embodiment, the movable handle 919 and the fixed handle 911 are provided with a soft rubberized foam outer gripping layer 965 and 967, respectively. A stronger elastomeric cushion 961, 963 is positioned underneath this layer directly over the metal portions of the handles. Of course, one skilled in the art will realize that a variety of materials may be utilized for this purpose. The elastomeric and grip materials may be installed over the handles as heat-shrinkable sections or via other forming methods.

In the present embodiment, the elastomeric portion 961 acts in combination with the grip portion 965 to hold the compound toggle link 922 substantially within the channel 921. In particular, the elongated end 980, shown in phantom, is prevented from fully pivoting out of the handle 919 by the elastomeric portion 961.

In this embodiment, the previous retention means may be utilized in combination to further secure or restrict the movement of the compound toggle link.

It is to be understood that certain changes may be made in the above disclosure without departing from the spirit and scope of the invention, and it is intended that all matter contained shall be interpreted as illustrative and not in a limiting sense. It is also to be understood that the following claims are intended to cover all of the generic and specific features of the invention herein described, and all statements of the scope of the invention which, as a matter of language might be said to fall therebetween.

What is claimed is:

1. A locking pliers comprising:

a body having a fixed handle and a fixed jaw;

a movable jaw coupled with said body;

a movable handle coupled with said movable jaw, said movable handle pivotally linked to a toggle locking mechanism to lock the jaws in a closed position; said toggle locking mechanism comprising a compound link comprising a flange end and an elongated lever end extending from said flange end; said compound link pivotally connected to said movable handle and to a toggle link; and retention means for restricting pivotal movement of said compound link relative to said movable handle wherein said retention means further comprises at least one hand gripping member extending over a portion of said movable handle.

2. A locking pliers comprising:

a body having a fixed handle and a fixed jaw;

a movable jaw coupled with said body;

a movable handle coupled with said movable jaw, said movable handle pivotally linked to a toggle locking mechanism to lock the jaws in a closed position; said toggle locking mechanism comprising a compound link comprising a flange end and an elongated lever end extending from said flange end; said compound link pivotally connected to said movable handle and to a toggle link; and retention means for restricting pivotal movement of said compound link relative to said movable handle wherein said retention means further comprises at least one hand gripping member comprising an elastomeric material extending over a portion of said movable handle.

3. An improved pliers-type, toggle-locking hand tool of the type comprising a body, a movable jaw pivotally connected with said body, a movable handle pivotally connected with said movable jaw and defining an elongated channel therein, a compound link pivotally connected to said movable handle, and a toggle link connected to said body, wherein the improvement comprises:

an elongated lever end portion defined on said compound link;

a restricting structure, comprising at least one hand gripping member extending over a portion of said movable handle, extending across said channel to restrict pivotal movement of a portion of said compound link outside of said channel of said movable handle.

4. A locking pliers comprising:

a body having a fixed handle and a fixed jaw;

a movable jaw coupled with said body;

a movable handle coupled with said movable jaw, said movable handle pivotally linked to a toggle locking mechanism to lock the jaws in a closed position, said toggle locking mechanism comprising a compound link pivotally connected to said movable handle and to a toggle link wherein said compound link further comprises a flange end and an elongated lever end extending from said flange end wherein said movable handle further comprises a channel defined within said movable handle, wherein said elongated lever end of said compound link is contained substantially within said channel throughout its range of pivotal movement; and retention means for restricting pivotal movement of said compound link relative to said movable handle wherein said retention means comprises a pin extending substantially across said channel to prevent movement of said elongated lever end of said compound link out of said channel.

5. An improved pliers-type, toggle-locking hand tool of the type comprising a body, a movable jaw pivotally connected with said body, a movable handle having a first and second handle wall, said movable handle pivotally connected with said movable jaw and defining sides of an elongated channel therein, a compound link pivotally connected to said movable handle, and a toggle link connected to said body, wherein the improvement comprises:

an elongated lever end portion defined on said compound link extending from a flange end; and a restricting structure defined on at least one of said first and second handle walls and extending at least partially across said channel to restrict the pivotal movement of a portion of said compound link outside of said channel of said movable handle.

6. The locking pliers of claim 5, wherein said flange end of said compound link further comprises a rounded edge opposite said elongated lever end, said rounded edge facilitating pivoting movement of said compound link relative to said movable handle.

7. The locking pliers of claim 5 wherein said restricting structure further comprises at least one flange portion defined on said movable handle extending transversely over said channel to prevent movement of said elongated lever end of said compound link out of said channel.

8. An improved pliers-type, toggle-locking hand tool of the type comprising a body, a movable jaw pivotally connected with said body, a movable handle having a first and second handle wall, said movable handle pivotally connected with said movable jaw and defining an elongated channel therein, a compound link pivotally connected to said movable handle, and a toggle link connected to said body, wherein the improvement comprises:

an elongated lever end portion defined on said compound link; and a restricting structure defined on at least one of said first and second handle walls and extending at least partially across said channel to restrict the pivotal movement of a portion of said compound link outside of said channel of said movable handle, where said restricting structure further comprises a pin extending substantially across the opening of said channel to prevent movement of said elongated lever end portion of said compound link out of said channel.

* * * * *

UNITED STATES PATENT AND TRADEMARK OFFICE

CERTIFICATE OF CORRECTION

PATENT NO. : 6,626,070 B2
DATED : September 30, 2003
INVENTOR(S) : William D. Peperkorn et al.

It is certified that error appears in the above-identified patent and that said Letters Patent is hereby corrected as shown below:

Column 8,
Line 8, before "an elongated" insert -- sides of --.

Signed and Sealed this

Sixteenth Day of November, 2004

JON W. DUDAS
*Director of the United States Patent and Trademark Office*